US007720406B2

(12) United States Patent
Tokunaga

(10) Patent No.: US 7,720,406 B2
(45) Date of Patent: May 18, 2010

(54) OPTICAL DEVICE AND IMAGE FORMING APPARATUS

(75) Inventor: Atsuo Tokunaga, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 190 days.

(21) Appl. No.: 11/798,111

(22) Filed: May 10, 2007

(65) Prior Publication Data

US 2007/0263283 A1 Nov. 15, 2007

(30) Foreign Application Priority Data

May 11, 2006 (JP) ..... 2006-132997

(51) Int. Cl.
*G03G 21/00* (2006.01)

(52) U.S. Cl. ..... 399/98

(58) Field of Classification Search ..... 399/98, 399/177, 218, 221, 99
See application file for complete search history.

(56) References Cited

U.S. PATENT DOCUMENTS 3,484,753 A * 12/1969 Boblett ..... 365/118
4,295,239 A * 10/1981 Myochin ..... 15/1.51
5,059,991 A * 10/1991 Morisawa ..... 347/138
5,673,187 A 9/1997 Tokunaga et al.
6,072,703 A 6/2000 Tokunaga
6,477,342 B2 * 11/2002 Komiya et al. ..... 399/98
2002/0170451 A1 * 11/2002 Nakazawa et al. ..... 101/463.1
2003/0184639 A1 * 10/2003 Shimomura ..... 347/132
2004/0258427 A1 * 12/2004 Takahashi ..... 399/69
2005/0057701 A1 * 3/2005 Weiss ..... 349/10

FOREIGN PATENT DOCUMENTS

JP 58021759 A * 2/1983
JP 08-244277 9/1996
JP 11-313481 11/1999
JP 2003005593 A * 1/2003

OTHER PUBLICATIONS

Translation of JP 2003-005593 A.*

* cited by examiner

*Primary Examiner*—David M Gray
*Assistant Examiner*—Gregory H Curran
(74) *Attorney, Agent, or Firm*—Harness, Dickey & Pierce, P.L.C.

(57) ABSTRACT

An optical device includes an optical element that transmits or reflects light, and scans the light onto a target surface to form a latent image on the target surface. The optical element includes a conducting portion that is located on at least any one of a light transmitting surface and a light reflecting surface, and a bias applying unit that applies a predetermined bias to the conducting portion.

13 Claims, 9 Drawing Sheets

OPTICAL DEVICE AND IMAGE FORMING APPARATUS

CROSS-REFERENCE TO RELATED APPLICATIONS

The present document incorporates by reference the entire contents of Japanese priority document, 2006-132997 filed in Japan on May 11, 2006.

BACKGROUND OF THE INVENTION

1. Field of the Invention

The present invention relates to an optical device, and an image forming apparatus.

2. Description of the Related Art

There have been utilized optical devices that include a light emitting element such as laser diode (LD) or light emitting diode (LED) to irradiate a target surface, and project an image from the target surface on various positions. Some image forming apparatuses, for example, copiers, printers, scanners, and facsimile machines, include such an optical device. In the optical devices and image forming apparatuses, if the performance is deteriorated by contamination of the surface of the optical element, treatments are usually performed to prevent contamination, to provide the optical element surface with contamination resistance, or to minimize performance deterioration even if the optical element is contaminated. If such treatments do not work well, contamination is removed or the optical element is replaced.

To prevent the contamination of the optical element surface or provide the optical element with the contamination resistance, a process is shut down that causes the contamination, a layout is provided that minimizes influences of gravity (a method of preventing horizontal layout), or a coating is applied that hardly attaches matters that can contaminate the surface.

To minimize the performance deterioration even if the optical element is contaminated, an image is enlarged on an optical path and focused on an irradiated surface, the amount of light is increased depending on the degree of contamination, or image processing is performed. Although there are many methods for removing contamination, such methods are not necessary if contamination is suppressed to a degree that the performance deterioration does not occur.

Meanwhile, electrophotographic devices with superior productivity and handling property become widely used as image forming apparatuses. Minimization of toner particles that influences greatly improvements in image quality has progressed. As toner particles have electric charges with a predetermined polarity because of their image forming function, they are easily attracted electrostatically. Therefore, measures against contamination of optical elements caused by toner are required.

For example, Japanese Patent Application Laid-Open No. H8-244277 discloses a conventional technology in which contamination of an optical system is prevented through the use of a power source that is effective for preventing contamination of charging wires and electrostatic absorption for attracting floating toners.

According to the conventional technology, contamination of an optical system is prevented by attracting floating toner around an optical element electrostatically. Toner that is actually floating in the image forming apparatus is usually moving not slowly but quickly to some extent because of airflow generated in the image forming apparatus.

Toner does not remain around the optical element but collides with the optical element to be attached thereto or removed therefrom. A few kilovolts of voltage must be applied to generate efficiently, on an electric field, an attraction force that is sufficient to detach once electrostatically attracted toner from the optical element by a predetermined spatial distance. Measures against leakage to the vicinity need to be also considered.

SUMMARY OF THE INVENTION

It is an object of the present invention to at least partially solve the problems in the conventional technology.

According to an aspect of the present invention, an optical device that scans light onto a target surface to form a latent image on the target surface, includes an optical element that transmits or reflects light. The optical element includes a conducting portion that is located on at least any one of a light transmitting surface and a light reflecting surface, and a bias applying unit that applies a predetermined bias voltage to the conducting portion to form an electric field that repels floating matters.

According to another aspect of the present invention, an image forming apparatus includes a developing device, an optical device that scans light onto a target surface to form a latent image on the target surface and includes an optical element that transmits or reflects light, and a power source. The optical element includes a conducting portion that is located on at least any one of a light transmitting surface and a light reflecting surface, and a bias applying unit that applies a predetermined bias voltage to the conducting portion to form an electric field that repels floating matters. The power source supplies the predetermined bias voltage to be applied to the conducting portion and a developing bias voltage to be applied to the developing device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
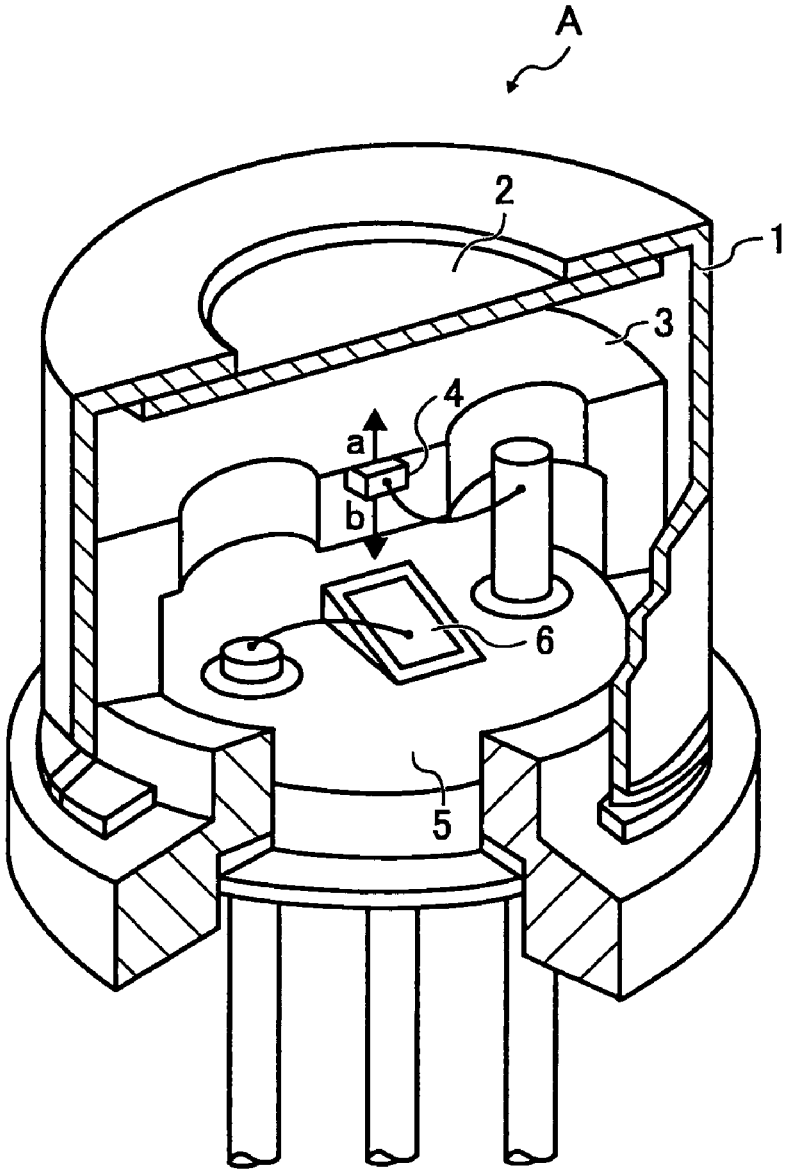
BACKGROUND ART FIG. 1
FIG. 1 is a cut-out schematic perspective view of a general laser diode unit.

FIG. 1 is a cut-out schematic perspective view of a general laser diode unit. In the laser diode unit A, a glass plate 2 is placed on the top surface of a cap 1, a laser (LD) chip 4 is placed on a heat sink 3, and a PIN chip 6 is placed on a stem 5 surrounded by the cap 1.

As shown in FIG. 1, the LD unit A is formed of a cladding layer and an active layer. Laser light emits from the LD chip through the glass plate 2 by electric charges from electrodes connected to the cladding layer (hereinafter, the light is referred to as "front beam a").

A back beam b which makes a pair with the front beam a is emitted to a photodiode (not shown, hereinafter, PD) in the LD unit A, so that PD outputs are obtained from the electrodes. The amount of beam light is thus monitored and control depending on monitor outputs is performed. Stable outputs are achieved with predetermined optical power.

In an image forming apparatus, toner is a primary floating matter that causes contamination. Therefore, among optical systems used in the image forming apparatus, structural examples of four representative optical devices are described.

Figure 2:
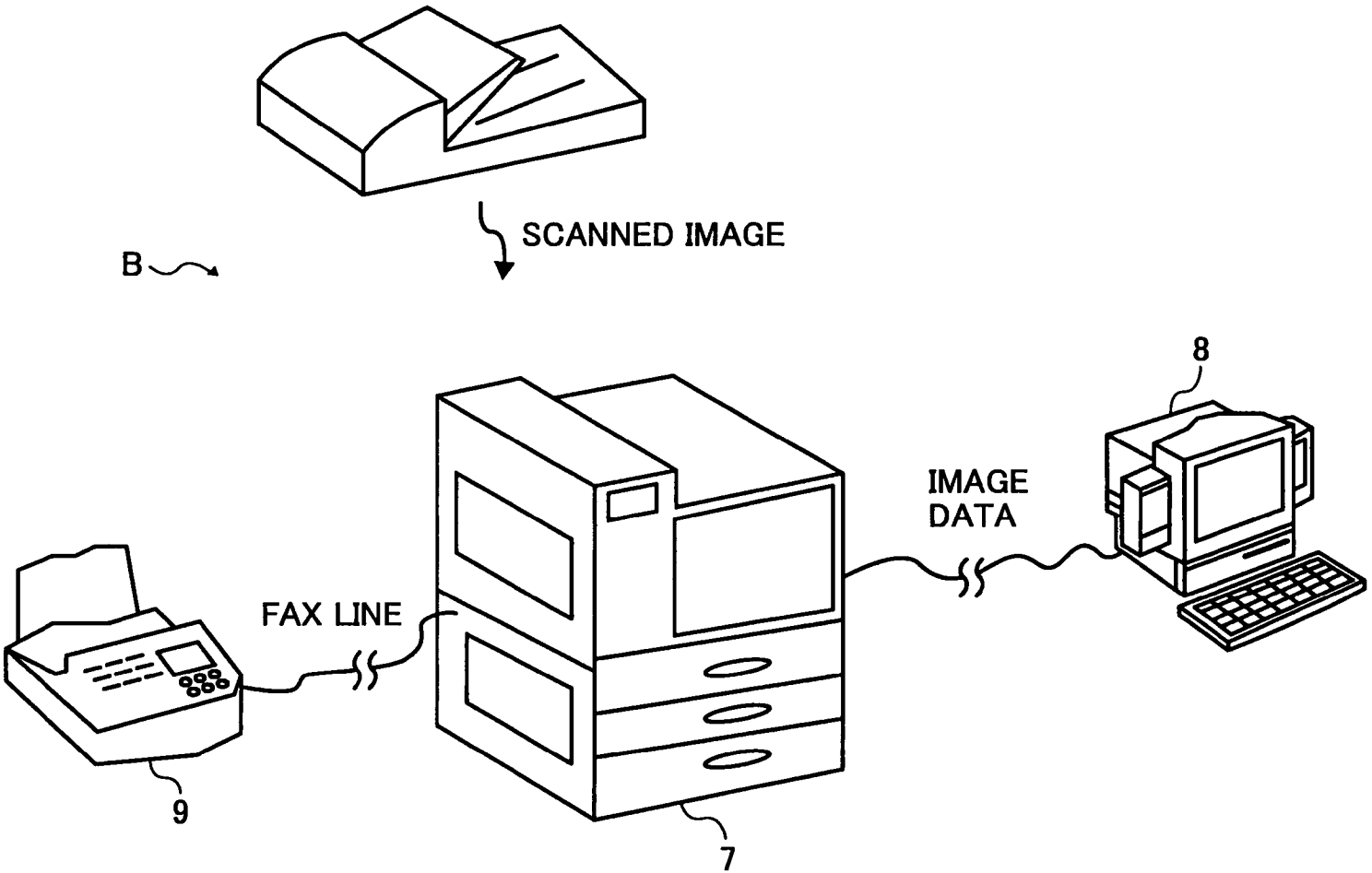
FIG. 2 is a schematic diagram of an image forming system according to an embodiment of the present invention.
Figure 3:
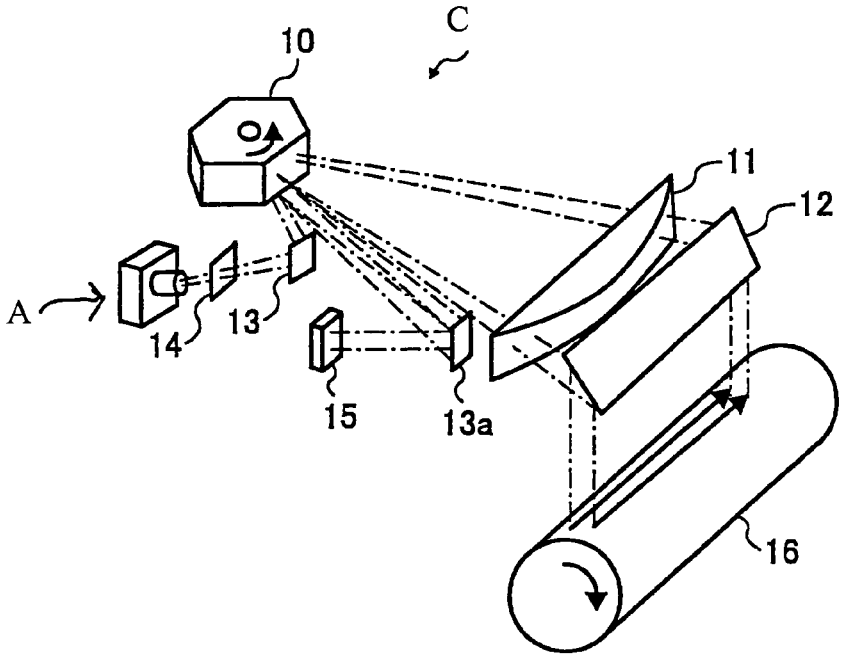
FIG. 3 is a schematic perspective view of an optical scanning device in an image forming apparatus shown in FIG. 2.
Figure 4:
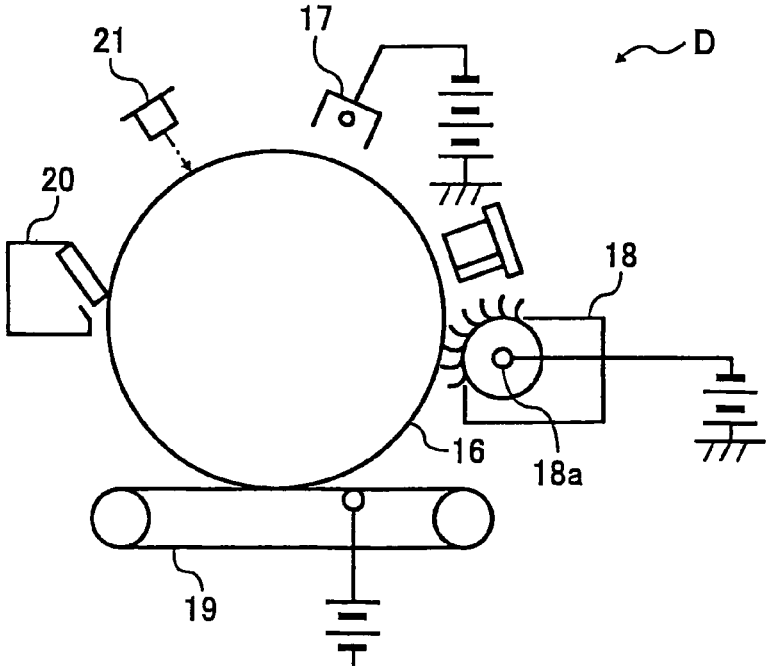
BACKGROUND ART FIG. 4
FIG. 4 is a schematic diagram of an image forming unit in the image forming apparatus shown in FIG. 2.

FIG. 2 is a schematic perspective view of an image forming system B according to an embodiment of the present invention. FIG. 3 is a schematic perspective view of an optical scanning device C in an image forming apparatus 7 shown in FIG. 2. FIG. 4 is a schematic diagram of an image forming unit D in the image forming apparatus 7. In the image forming system B, a personal computer (PC) 8 and a facsimile machine 9 are connected to the image forming apparatus 7.

The structural example of the optical scanning device which utilizes an LD is described with reference to FIG. 3. The optical scanning device C is formed of the LD unit A, an optical element that shapes a beam diameter for laser light emitted from the LD unit A before guiding to the scanned surface, and a control unit that controls LD light.

With reference to FIG. 3, a writing unit of an exposure unit in the optical scanning device C includes the light emitting element A, a polygon mirror 10 serving as the optical element, an fθ lens 11, a fold mirror 12, mirrors 13 and 13*a*, a cylindrical lens 14, a synchronization detection sensor 15 that performs synchronization detection for generating LD light emitting timing, and a scanning optical system that exposes a photosensitive drum (photoconductor) 16 having the scanned surface to a plurality of beams with predetermined distances therebetween.

The image forming unit D in the image forming apparatus 7 includes a charging device 17, a developing device 18, a transfer device 19, a cleaning device 20, and a neutralization device 21 around the photosensitive drum 16 on which a latent image is formed for performing charging, exposure, development, transfer, and cleaning processes.

The image forming apparatus 7 includes, although not shown, a feeding unit that feeds a transfer sheet with an image formed thereon, a fixing unit that fixes the transferred image, and a discharge unit that discharges the fixed transfer sheet.

To form images from image data read by a scanner and a digital camera, image data prepared on the PC 8, and image data for the facsimile machine 9 received by a telephone line, the image data is passed through an image I/F unit to which the image data is inputted and an image processor for storing or editing/image processing the inputted image data. A latent image is then formed by the LD control unit. As an image forming apparatus with a plurality of light emitting elements, there provided apparatuses with a plurality of LD units and apparatuses configured by LD arrays including LD units.

Figure 5:
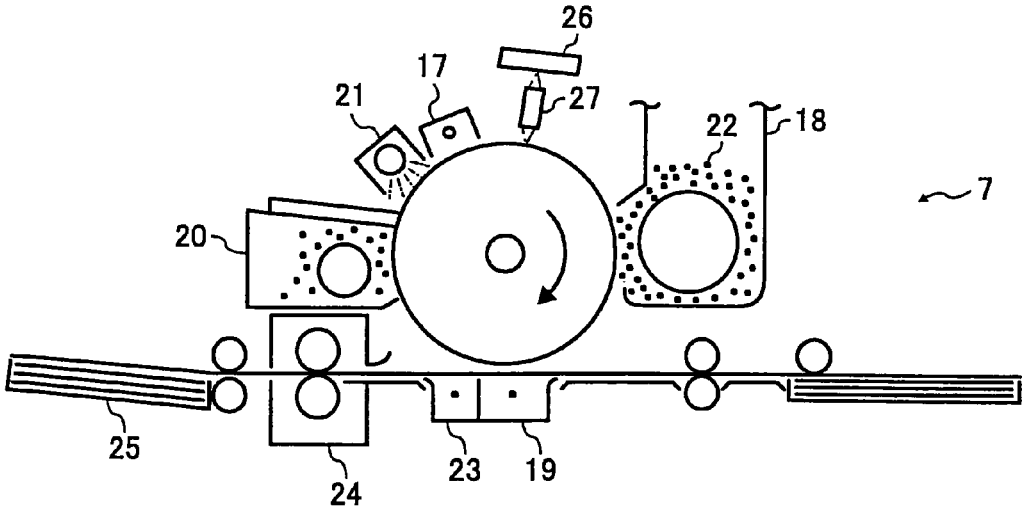
BACKGROUND ART FIG. 5
FIG. 5 is a schematic diagram of an image forming apparatus that utilizes an LED printer head.
Figure 6:
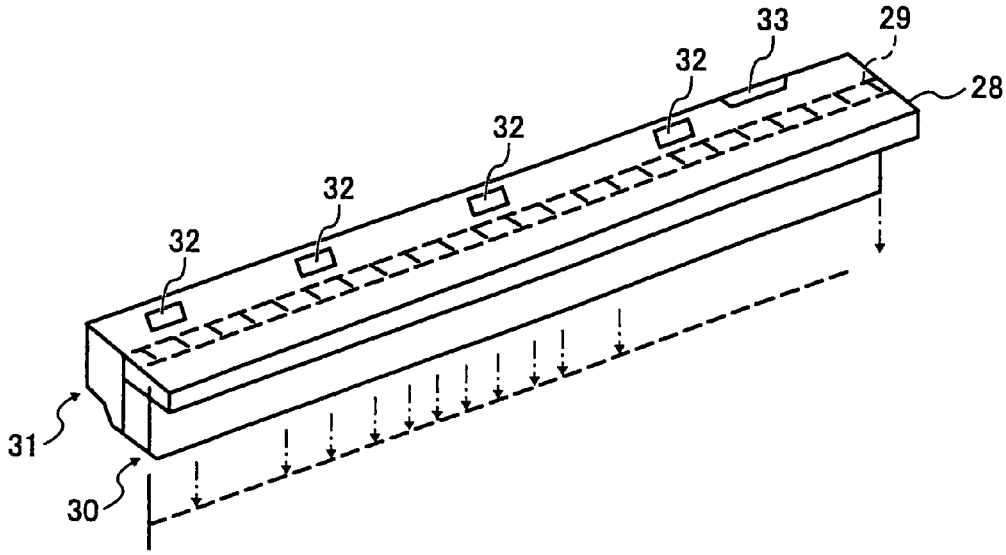
BACKGROUND ART FIG. 6
FIG. 6 is a schematic perspective view of the LED printer head serving as an optical scanning device in the image forming apparatus shown in FIG. 5.
Figure 7:
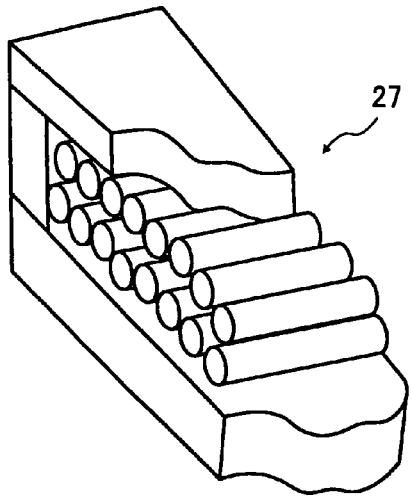
BACKGROUND ART FIG. 7
FIG. 7 is a schematic partial perspective view of an example of a SELFOC™ lens in the image forming apparatus shown in FIG. 5.

FIG. 5 is a schematic diagram of an image forming apparatus that utilizes an LED printer head. FIG. 6 is a schematic perspective view of the LED printer head serving as the optical scanning device incorporated in the image forming apparatus shown in FIG. 5. FIG. 7 is a schematic partial perspective view of an example of a SELFOC™ lens incorporated in the image forming apparatus shown in FIG. 5.

A structural example of the image forming apparatus that includes an optical writing device utilizing the LED printer head (hereinafter, LPH) is described. With reference to FIGS. 5 to 7, the image forming apparatus 7 includes the charging device 17, the developing device 18, the transfer device 19, the cleaning device 20, the neutralization device 21, toner 22 within the developing device 18, a separating device 23, a fixing device 24, and a stacker 25.

The image forming apparatus 7 includes, as shown in FIG. 6, an LPH 26 made by arranging a plurality of integrated LED chips. The LPH 26 is configured by LED array elements 29 on the back surface of a substrate 28, an equi-magnification lens 30, a heatsink 31, driver elements 32, and an I/F unit 33 on the top surface of the substrate 28.

The image forming apparatus 7 includes a SELFOC$^{198}$ lens array 27 with the configuration shown in FIG. 7. The LPH of the image forming apparatus 7 shown in F*ig*. 5 is formed by arranging a plurality of integrated LED chips and performs imaging by the SELFOC$^{198}$ lens array 27. As compared to the optical scanning device shown in FIG. 3, the conflguration of the LPH is simpler and space saving is easily realized. The LPH has been used conventionally for facsimile machines and printers.

However, because each of LEDs in the LPH has a little light amount and its integration degree is hard to be improved, the LPH seems to be behind recent density growth. As LEDs vary with each other, correction for light amount is required.

The light emission mechanism for LED is roughly classified into a strobe mechanism and a dynamic mechanism. In the strobe mechanism, light emission data is transferred to each LED and all LEDs are turned on by strobe signals.

The strobe mechanism is usually performed in a divided manner to reduce a data transfer rate and prevent a great change in input current at the time of turning on LEDs. Although the dynamic mechanism requires a complicated control circuit, it has an advantage of small change in input current because the respective LEDs are turned on in a dynamic manner.

Figure 8:
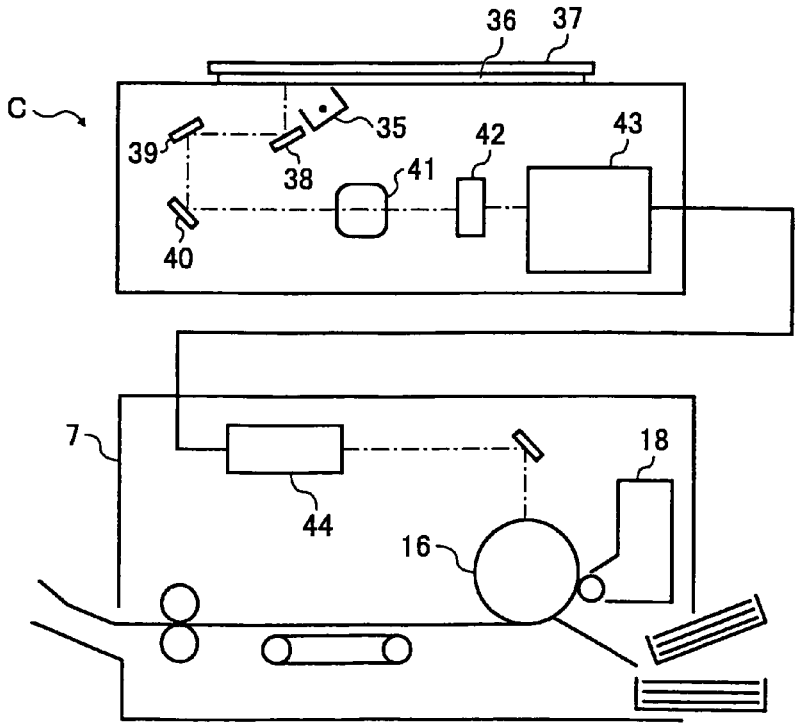
BACKGROUND ART FIG. 8
FIG. 8 is a schematic diagram of an image forming apparatus that includes an image reading device utilizing a reduced optical system.

FIG. 8 is a schematic diagram of the image forming apparatus 7 that includes an image reading device utilizing a reduced optical system. An image reading unit of the image forming apparatus 7 includes, in its scanning unit, a light source 35 and a first mirror 38 that irradiates light from a reflecting mirror which converges light from the light source on an original 37 placed on a contact glass 36 and that reflexes a reflected light image from the original 37.

The image reading unit reflexes an image from the first mirror 38 via a second mirror 39 and a third mirror 40 to allow the image to transmit thorough a lens 41 and image on a reading sensor 42.

A charge-coupled device (CCD) sensor is usually used for the reading sensor 42. A one-line sensor used for monochrome images and a three-line sensor used for color images are provided. Color images are sometimes read with the one-line sensor in a manner that scanning is performed for several times with different wavelengths of the light source 35. Since applications of downloading images in PCs have been improved recently, images are read as red-green-blue (RGB) information. A xenon or fluorescent lamp is used for the light source 35.

The three-line sensor requires a memory (not shown) for correcting the distance between the sensors in an image processor 43. On basic reading conditions (scanning rate and reading density), the distance between the sensors is made to be a predetermined distance (integer multiplication of pixel size on the sensor).

When color imaging is performed by switching the light source 35 in the one-line sensor, the distance between the sensors needs not to be corrected. An image memory that is capable of storing the entire reading area at least twice is required.

In the image forming apparatus of FIG. 8, an electric signal from the image processor 43 is inputted to an writing optical system 44 in the printer unit. The photosensitive drum 16 is then exposed with light. An electrostatic latent image on the photosensitive drum 16 is developed by the developing device 18. The developed image is transferred to a transfer sheet by the transfer device 19. The transfer sheet with the transferred image is thermally fixed by the fixing device 24 and discharged outside the machine.

Figure 9:
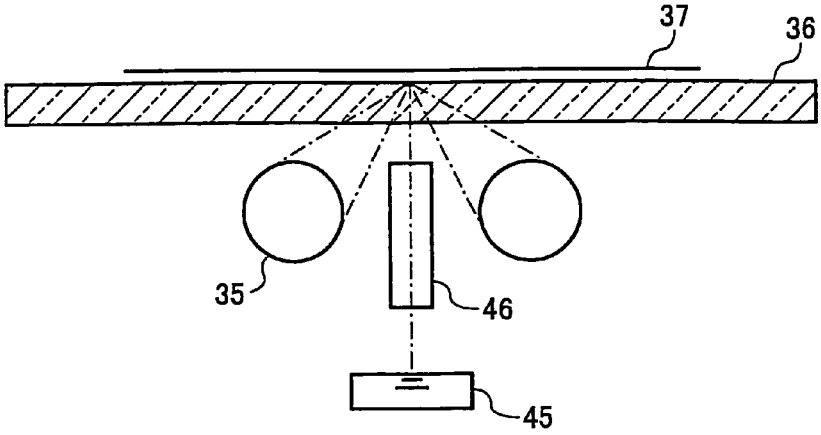
BACKGROUND ART FIG. 9
FIG. 9 is a schematic diagram of an image reading device utilizing an equi-magnification optical system that is incorporated in an image forming apparatus.

FIG. 9 is a schematic diagram of an image reading device utilizing an equi-magnification optical system that is incorporated in the image forming apparatus. The image reading device includes a white light source 35 for Irradiating the original 37 on the contact glass 36, an equi-magnification sensor 45, and an equi-magnification lens 46. A SELFOC[198] lens is usually utilized for the equi-magnification lens.

The image reading device with such a configuration has a larger pixel size for the sensor as compared to the reduced optical system. In addition to CCD sensors, metal-oxide semiconductor (MOS) sensors are usually utilized. Larger pixel size improves the sensitivity of the sensor. Shorter optical path due to the equi-magnification lens 46 enables a decreased amount of light from the light source 35. In addition to xenon and fluorescent lamps, LEDs and organic ELs are utilized for the light source 35.

Figure 10:
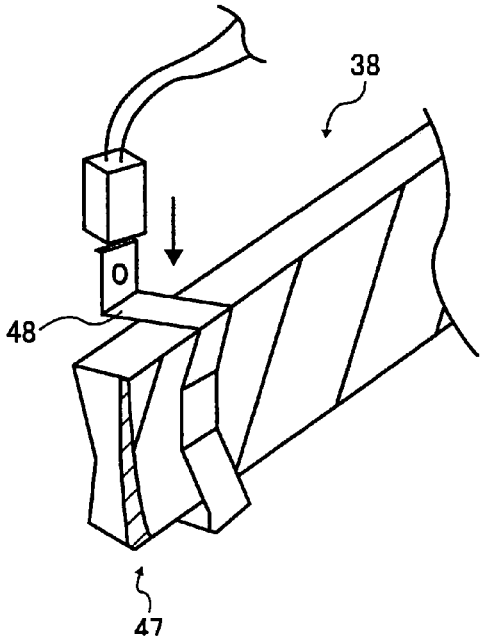
FIG. 10 is a schematic perspective view of a part of a mirror of an optical device.
Figure 11:
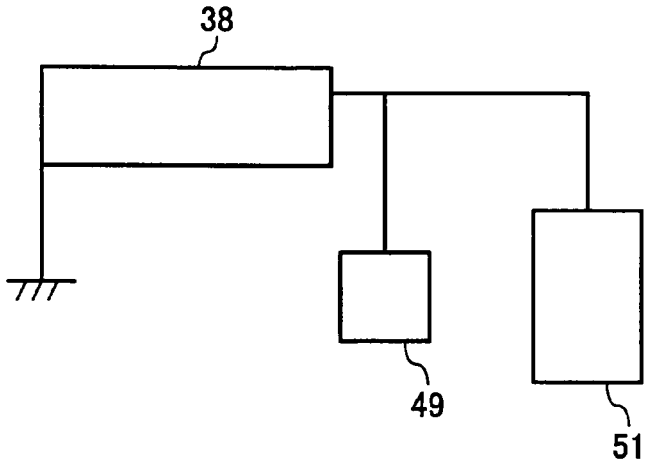
FIG. 11 is a schematic circuit diagram of a bias load to the mirror of the optical device.

FIG. 10 is a schematic perspective view of a part of a mirror of an optical device. FIG. 11 is a schematic circuit diagram of a bias load to the mirror of the optical device. A method for applying a bias to optical elements of the optical devices exemplified above is described with reference to FIGS. 10 and 11. A mirror of the optical device, e.g., the first mirror 38 shown in FIG. 8 has an aluminum evaporation layer (conducting portion) 47 made by evaporating aluminum on its mirror surface.

The aluminum evaporation layer 47 which is the mirror surface made by aluminum evaporation is conductive. An electrode is thus formed with a leaf spring 48 serving as a retainer. Insulation to a member (not shown) connected to GND by a case (not shown) is maintained. The desired bias is applied to the surface by receiving bias from a power source (not shown).

As shown in FIG. 11, the optical element (first mirror) 38 is connected to GND by the case (not shown). The desired bias is applied from a bias source (bias applying unit) 51 to the surface, i.e., the aluminum evaporation layer 47 (FIG. 10). The bias circuit includes a display unit 49 for informing performance deterioration over time, which is described below.

Films (conducting portions) made of conductive polymers (polyethylenedioxythiophene or the like) are coated on surfaces of lenses made of glass and plastic. The bias is similarly applied to the surface and an electric field for repelling floating matters is formed on the surface of the optical element.

Impedance on the surface of the conducting portion varies depending on thicknesses and materials of the coating portion (conducting portion). According to the embodiment, the conducting portion is basically configured to be insulated from the environment unless there are specific reasons with respect to the optical element and the configured system, the load impedance is large. Differences in effects due to impedance characteristics need not to be considered.

A power source for supplying a bias is explained below. The bias is supplied from a converter power source that utilizes ordinary transformers (not shown). Because of large load impedance, a converter power source that utilizes piezoelectric elements is also preferable.

Optimal values of voltage required for applying bias vary depending on image forming apparatuses. The voltage is generally the same as that applied to toner in the developing unit and is approximately −600 Volts.

According to the embodiment described above, by applying a bias for forming an electric field which repels floating matters against the desired optical element to the conducting portion on the surface of the optical element, floating matters with electric charges are prevented from attracted to the optical element.

Accordingly, in the optical device that requires regular maintenances, the interval between the maintenances is significantly extended, as well as making the maintenances and cleaning mechanisms unnecessary. This technology is especially effective for configurations that are difficult to perform maintenance because of space saving and compactness and that cannot incorporate the cleaning mechanism.

If the embodiment is applied to a system, which is usually problem-free but suffers from contamination due to installation environment or application, as a function of preventing contamination, quick actions are easily taken because of its simple configuration, and downtime for users is reduced.

The above description has been made by taking toner as an example of floating matters. Toner generally has electric charge to form a visible image on a photoconductor, and the electric charge of toner is identified. Contamination prevention bias for floating toner is thus easily set.

However, if electric charges of floating matters are not identified or the floating matters do not have electric charges, the contamination prevention bias can attract the floating matters electrostatically. In such a case, it is effective to supply a bipolar bias in a switched manner.

In practice, voltage waveforms including sine waveform, rectangular waveform, and triangular waveform are made at a predetermined period. The bias is then supplied by controlling offsets at a DC output if necessary. Attraction force to the optical element is effectively reduced.

Repelling of floating matters is realized by the contamination prevention bias and attraction of the floating matters to the optical element is prevented by reducing the attraction force. However, the floating matters can exist around the optical element. When the floating matters are accumulated even if they do not have any attraction force, the matters can affect the system optically.

In this case, it is effective to remove the floating matters using brushes and blades. However, at the time of removal, if some of the floating matters are not removed and remains, such remained matters can form lines or dots and exert another influence on the system. Therefore, it is more effective to move the floating matters by air.

Figure 12:
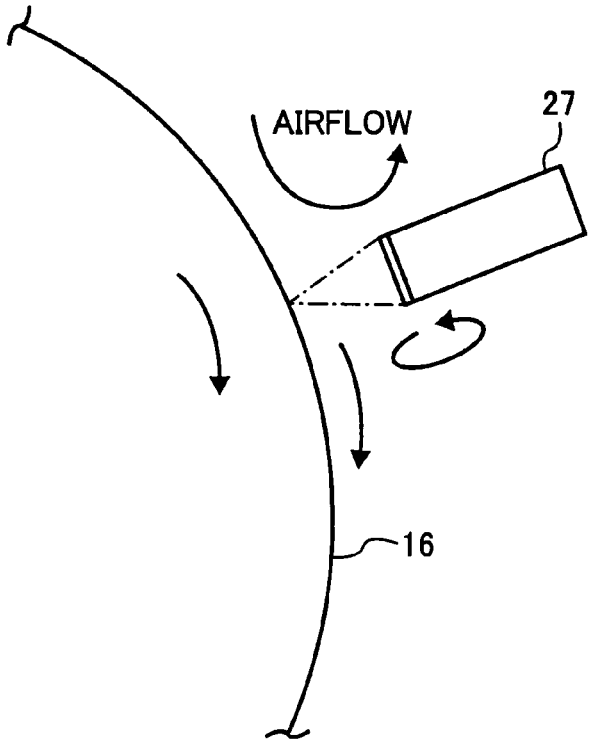
FIG. 12 is a schematic diagram for explaining airflow on an optical element.

FIG. 12 is a schematic diagram for explaining airflow on an optical element. With reference to FIG. 12, if airflow exists on the optical element (writing SELFOC™ lens) 27, floating matters with no attraction force are moved downstream and hardly accumulated. The moved floating matters are removed by filters or attraction elements at a downstream position that is apart from the optical element 27, which reduces adverse affects on other units.

The intensity of the airflow on the optical element 27 is set not to accelerate accumulation on the optical element 27. For example, around the photosensitive drum 16, the airflow generated by the operation of the photosensitive drum 16 works sufficiently.

The same voltage as that applied to toner is applied to the optical element. The voltage is supplied to the optical element by diverging from the power source for supplying developing bias for the developing device 18 (power source for supplying developing bias for developing roller 18*a*). This configuration achieves cost reduction as compared to a case of providing a power source only for contamination prevention. Further, the same potential as the potential of floating toner is always supplied by following changes in the developing bias.

If the period during which toner is floating is not always the same as the timing for applying the developing bias, it can be optimized by providing a switch element for switching. If the contamination prevention bias needs to be applied despite the developing bias being turned off, the switch element is provided on a line for supplying to the developing bias to perform on-off control.

In the technology for supplying voltage from not the power source for contamination prevention but other power source, when higher output voltage than the contamination prevention bias is supplied, as described in the structural examples, the contamination prevention bias is generated by resistance dividing because of its large load impedance. A simple configuration is thus realized.

The contamination prevention bias is proved to be effective for undulating voltage and pulse voltage as well as direct current (DC) voltage. The scope of selection for power sources utilized commonly among image forming apparatuses is widened. The power source for applying bipolar bias is particularly cost advantageous.

The relationship between the contamination prevention bias and the airflow for moving the floating matters needs to be controlled depending on the state of the floating matters near the optical element. On the periphery of the photoconductor of the image forming apparatus, for example, when the photoconductor is driven to rotate so that an image is formed thereon, the airflow is generated. When the photoconductor is stopped, the airflow is not generated.

Generally, the photoconductor is driven and the developing bias is then applied. The photoconductor stops driving after the developing bias is stopped. If floating matters are toner, by applying the contamination prevention bias at least during the period when the photoconductor is driven and the airflow is generated, attraction of the floating matters near the optical element is prevented when the largest amount of floating matters exist.

If there is no airflow, new floating matters are not attracted around the optical element, and application of the contamination prevention bias is stopped. Depending on influences on the optical element, the contamination prevention bias always needs to be applied. However, because toner holds electric charge during a finite period, the period of driving the photoconductor after application of the developing bias is stopped is extended to minimize the influences.

Figure 13:
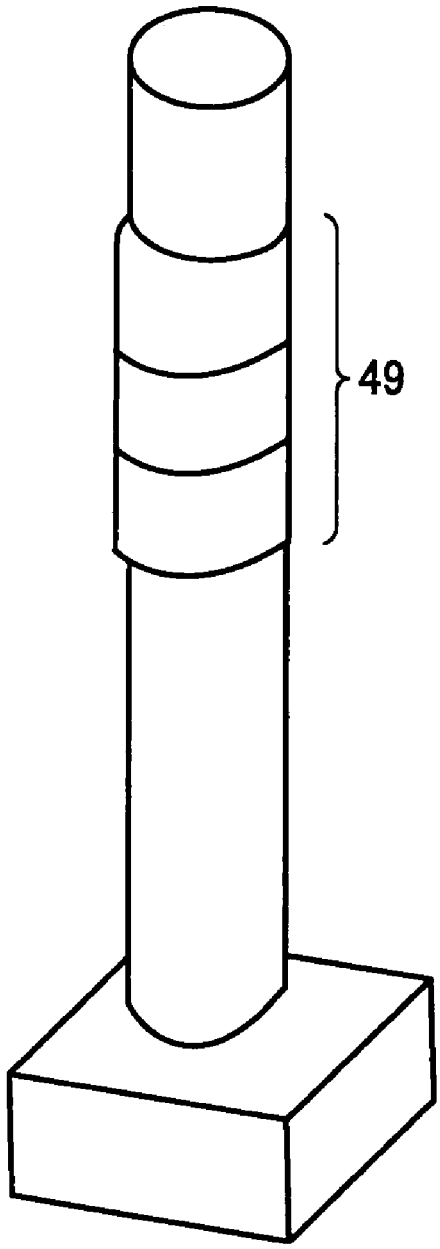
FIG. 13 is a schematic diagram of a display unit that informs performance deterioration of a device over time.
Figure 14:
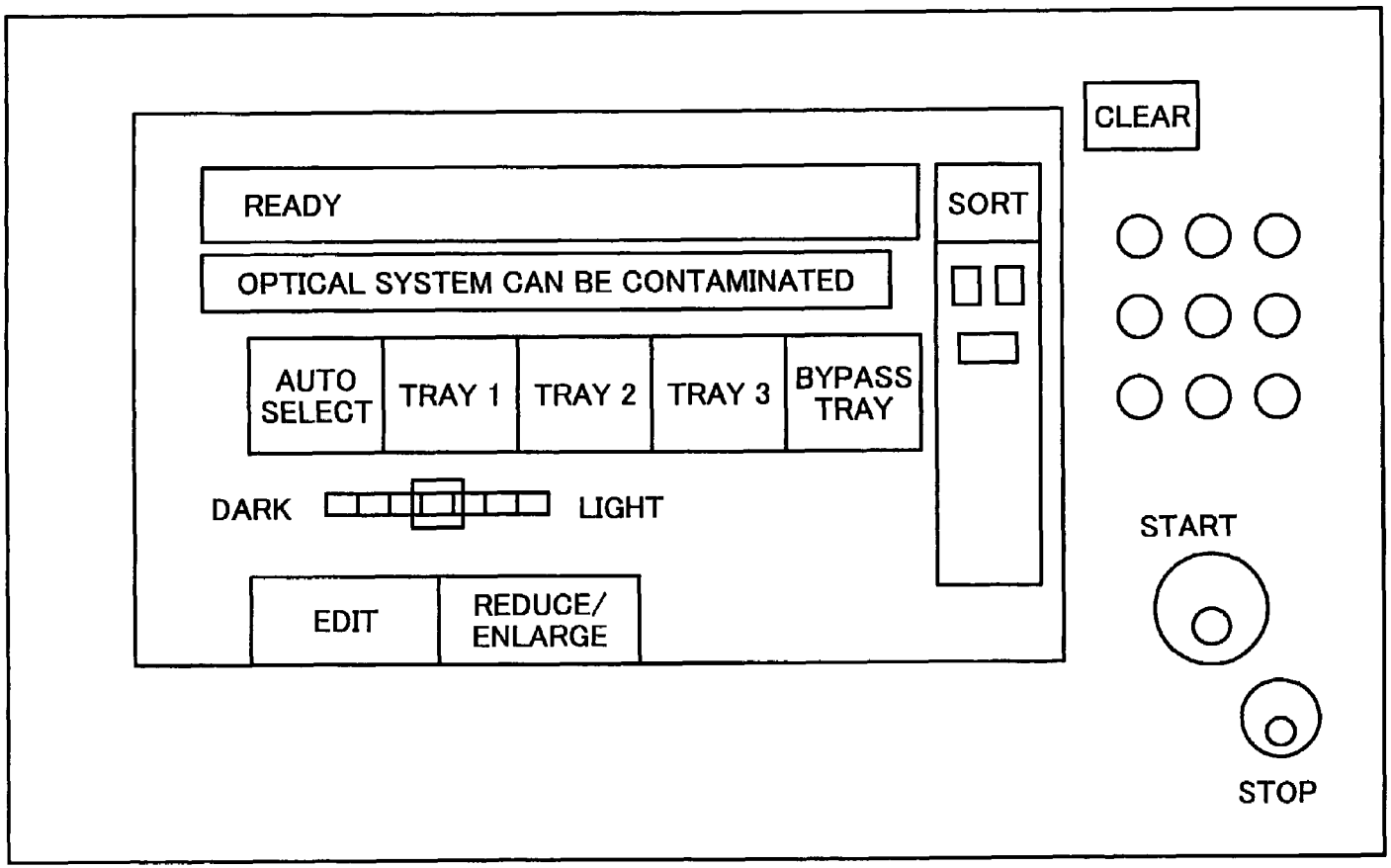
FIG. 14 is a schematic diagram of another display unit that informs performance deterioration of a device over time.

FIG. 13 is a schematic diagram of a display unit that informs performance deterioration of a device over time. FIG. 14 is a schematic diagram of another display unit that informs performance deterioration of a device over time.

The technology related to the contamination prevention bias is aimed at reducing influence with respect to contamination of the optical system. If the contamination prevention bias is not applied because of its leakage, the performance of the device over time can be deteriorated. The performance deterioration does not affect functions of the device immediately, and these functions can be recovered by cleaning.

Because functional problems are not presented immediately as described above, instead of stopping such functions, the lamp (display unit) 49 shown in FIG. 13 is turned on. Alternatively, a comment 50 such as "optical system can be contaminated" is displayed on a display screen shown in FIG. 14 to inform a user or a serviceperson of an appropriate operation such as repair.

As set forth hereinabove, according to an embodiment of the present invention, an aluminum evaporation layer which is a mirror surface made by aluminum evaporation is conductive, and an electrode is formed with a leaf spring serving as a retainer. Isolation to a member connected to GND by a case is maintained. The desired bias is applied to the surface by supplying bias from a power source. The bias for forming an electric field for repelling floating matters against the desired conductive optical element is formed. The floating matters are prevented from being attracted to the optical element.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical device that scans light onto a target surface to form a latent image on the target surface, the optical device comprising:

an optical element that transmits or reflects light, and includes a conducting portion located on at least one of a light transmitting surface and a light reflecting surface of the optical element; and a bias applying unit that applies a predetermined bias to the conducting portion to form an electric field that repels floating matter, wherein said bias applying unit is configured to apply at least one of an undulating voltage and a pulse voltage, as well as direct current (DC) voltage, by sharing another power source originally provided for another component in a device in which the optical device is provided.

2. The optical device according to claim 1, wherein the predetermined bias has a polarity identical to polarity of toner.

3. The optical device according to claim 1, wherein the bias applying unit applies the predetermined bias to the conducting portion while switching polarity of the predetermined bias.

4. The optical device according to claim 1, further comprising an airflow generating unit that generates airflow on the conducting portion.

5. The optical device according to claim 4, wherein the predetermined bias applying unit is configured to be on-off controlled in a state where no airflow is generated on the conducting portion.

6. The optical device according to claim 1, further comprising a display unit configured to display an indication that application of the predetermined bias to the conducting portion is to be terminated when a failure is detected.

7. The optical device according to claim 6, wherein the display unit is configured to display an indication that performance of the optical element is deteriorated.

8. The optical device according to claim 1, wherein the optical element includes an aluminum evaporation layer.

9. The optical device according to claim 8, wherein the aluminum evaporation layer is the conducting portion.

10. The optical device according to claim 8, further including a leaf spring attached to a surface of the optical element.

11. The optical device according to claim 1, wherein the optical element is a mirror and the conducting portion is on the light reflecting surface.

12. The optical device according to claim 1, wherein the conducting portion is a conductive polymer.

13. An image forming apparatus comprising:

a developing device;

an optical device that scans light onto a target surface to form a latent image on the target surface, and includes an optical element that transmits or reflects light, the optical element including a conducting portion located on at least one of a light transmitting surface and a light reflecting surface and a bias applying unit that applies a predetermined bias to the conducting portion to form an electric field that repels floating matter; and a power source that supplies the predetermined bias to be applied to the conducting portion and a developing bias to be applied to the developing device, wherein said bias applying unit is configured to apply at least one of an undulating voltage and pulse voltage, as well as direct current (DC) voltage, by sharing the power source originally provided for the developing device.

* * * * *